United States Patent [19]

Steen

[11] 4,097,701

[45] Jun. 27, 1978

[54] COAXIAL POLARITY REVERSING SWITCH WITH ROTARY ACTUATION

[75] Inventor: Donald B. Steen, Bowie, Md.

[73] Assignee: The United States of America as represented by the Secretary of the Navy, Washington, D.C.

[21] Appl. No.: 764,929

[22] Filed: Feb. 2, 1977

[51] Int. Cl.[2] ..... H01H 3/00; H01H 19/28

[52] U.S. Cl. ..... 200/153 S; 200/155 R; 200/304

[58] Field of Search ..... 200/153 S, 155 R, 51 R, 200/304, 305

[56] References Cited

U.S. PATENT DOCUMENTS

| | | | |
|---|---|---|---|
| 2,745,917 | 5/1956 | Gates | 200/153 S X |
| 3,141,943 | 7/1964 | Lanctot | 200/153 S |
| 3,495,060 | 2/1970 | Biggs | 200/153 S |

*Primary Examiner*—William Price

*Assistant Examiner*—Steven M. Pollard

*Attorney, Agent, or Firm*—R. S. Sciascia; Q. E. Hodges

[57] ABSTRACT

A coaxial, polarity switch, for insertion in and electrical connection to a coaxial power transmission line, designed to carry high currents. Coaxial transmission lines are used to contain stray magnetic fields and this coaxial switch maintains the coaxial relationship. An outer rotary switch member, made up of insulators and conductors, is rotatable about a fixed inner switch member, and has multi-louvered contact material, containing many contact points, to conduct the high current. The outer switch member, in one position, maintains forward polarity; in a central position, the switch is off; in a third position, the polarity is reversed. Thus the switch is a DPDT, center-off type, but SPST, SPDT, and DPST types are possible. Non-conductive coolant may be circulated through passages in the switch, and may be sealed in the switch by seal members.

11 Claims, 5 Drawing Figures

COAXIAL POLARITY REVERSING SWITCH WITH ROTARY ACTUATION

The invention described herein may be manufactured and used by or for the Government of the United States of America for governmental purposes without the payment of any royalties thereon or therefor.

BACKGROUND OF THE INVENTION

This invention relates to electrical switches, and more particularly to a coaxial switch for insertion in and electrical connection to a coaxial transmission line, carrying high current to minimize stray magnetic fields.

Direct current transmission systems, whether they be for superconducting machines, welding, or power distribution, generally produce large stray magnetic fields caused by the current passing through the conductor. These fields have many detrimental manifestations. One problem is that parallel conductors must be tightly secured to preclude adverse effects from the attraction or repulsion between the conductors. Another possible detrimental effect is the stray magnetic field itself, which may be detrimental to other near by equipment, and aboard ship, such magnetic fields are capable of enemy detection, and of activating magnetic mines and torpedoes.

One of the best ways of eliminating or containing these stray magnetic fields is by transmitting the current through the use of coaxial transmission lines, which have no external field. Because in electrical circuitry it is often desirable to reverse polarity, or to merely switch the current distribution, there exits conventional non-coaxial switch-gear. But such conventional switch gear used with a coaxial line presents complex design problems, because the coaxial cable has to be broken, high current conductors have to be attached, and then routed to the switch gear. The most important problem is that once the coaxial line feature is interrupted, stray magnetic fields are produced from the non-coaxial conductors and components, etc., and therefore complex shielding means have to be used.

Coaxial switches in the prior art have been used for many years, particularly in radio antenna switching networks, but they do not usually involve high currents. Some of these switches are merely "on-off" types, and some are single pole, double throw (SPDT) transfer switches. However, one feature that is absent from practically all coaxial switches in the prior art is the switching of the current in the outer conductor or shield element; and totally non-existant in the prior art known to applicant seems to be the feature of polarity reversal in coaxial switches; that is, connecting the center conductor to the shield, and connecting the shield to the center conductor through the switch when the switch is inserted between the ends of a coaxial cable.

SUMMARY OF THE INVENTION

Briefly, the instant invention overcomes the disadvantages of the prior art coaxial switches by providing a coaxial, polarity-reversing switch, that is insertable into a coaxial power transmission line, without disturbing the containment of the stray magnetic fields. This switching is accomplished without the need for complex switching gear and shielding. The coaxial switch mechanically connects to the shield and center conductor of the coaxial line by simply plugging into the line using connectors that maintain electrical contact with low ohmic loss. The switch switches without load current, and then carries very high load currents, e.g., over 30,000 amperes. It is used particularly for polarity reversal; that is, positive direct current may enter on the inner conductor and exit on the outer conductor; negative direct current enter-on the outer conductor and exit on the inner conductor or vice versa. The switch has an "off" position, and a non-reversing or forward polarity position, thus making it a double-pole, double throw (DPDT), center "off" type switch. SPST, SPDT, and DPDT switches are possible with other configurations of design because the DPDT switch contains all the required elements of the others. A rotatable switch member, the outer member, as described hereinafter, is provided to perform the switching operation within the switch and is made of conductive and insulative materials for carrying current to and from the proper inner and outer conductors of the transmission line. Multilouvered ("Multilam") multi-contact material is used at each movable contact and coaxial line connection to conduct high current and keep ohmic losses low. Nonconductive coolant fluid may be circulated through passages to remove $I^2R$ heat build up.

The coaxial transmission line may be made of economical and light weight aluminum, with the inner and outer conductors thereof, spaced from each other by longitudinal insulative strips to allow the flow of nonconductive coolant therebetween. The line conductors are gripped at their ends by connectors in the switch with "Multilam" contacts therein which allow for longitudinal movement. Within the connectors is an expansion space which accomodates any movement of the switch and transmission line that may occur due to heat and shock. The connectors also allow for the switch to be easily plugged into the coaxial transmission line. The rotatable switch conductive member may be made of copper for better conductivity.

STATEMENT OF THE OBJECTS OF THE INVENTION

Accordingly, an object of the invention is to provide a new, improved, and efficient coaxial switch.

Another object of the instant invention is to provide a coaxial, polarity-reversing switch for ready insertion into coaxial electrical transmission lines.

Still another object of the present invention is to provide a coaxial switch for coaxial transmission lines that will contain stray magnetic fields.

A further object of the instant invention is to provide a coaxial switch for coaxial lines capable of switching the outer conductor shield.

A still further object of the instant invention is to provide a plug-in coaxial switch for coaxial transmission lines that allows for heat expansion.

Still another object of the present invention is to provide a coaxial, polarity-reversing switch that will carry very high currents (30,000 amperes and above) without significant $I^2R$ heat losses.

BRIEF DESCRIPTION OF THE DRAWINGS

Other objects, advantages, and novel features of the invention will become apparent from the following detailed description of the invention when considered in conjunction with the accompanying drawings wherein.

FIGS. *2a*, *2b*, and *2c* show cross-sectional views of the coaxial switch in forward, "off", and reverse polarity positions.

DESCRIPTION AND OPERATION OF THE PREFERRED EMBODIMENT

Figure 1:
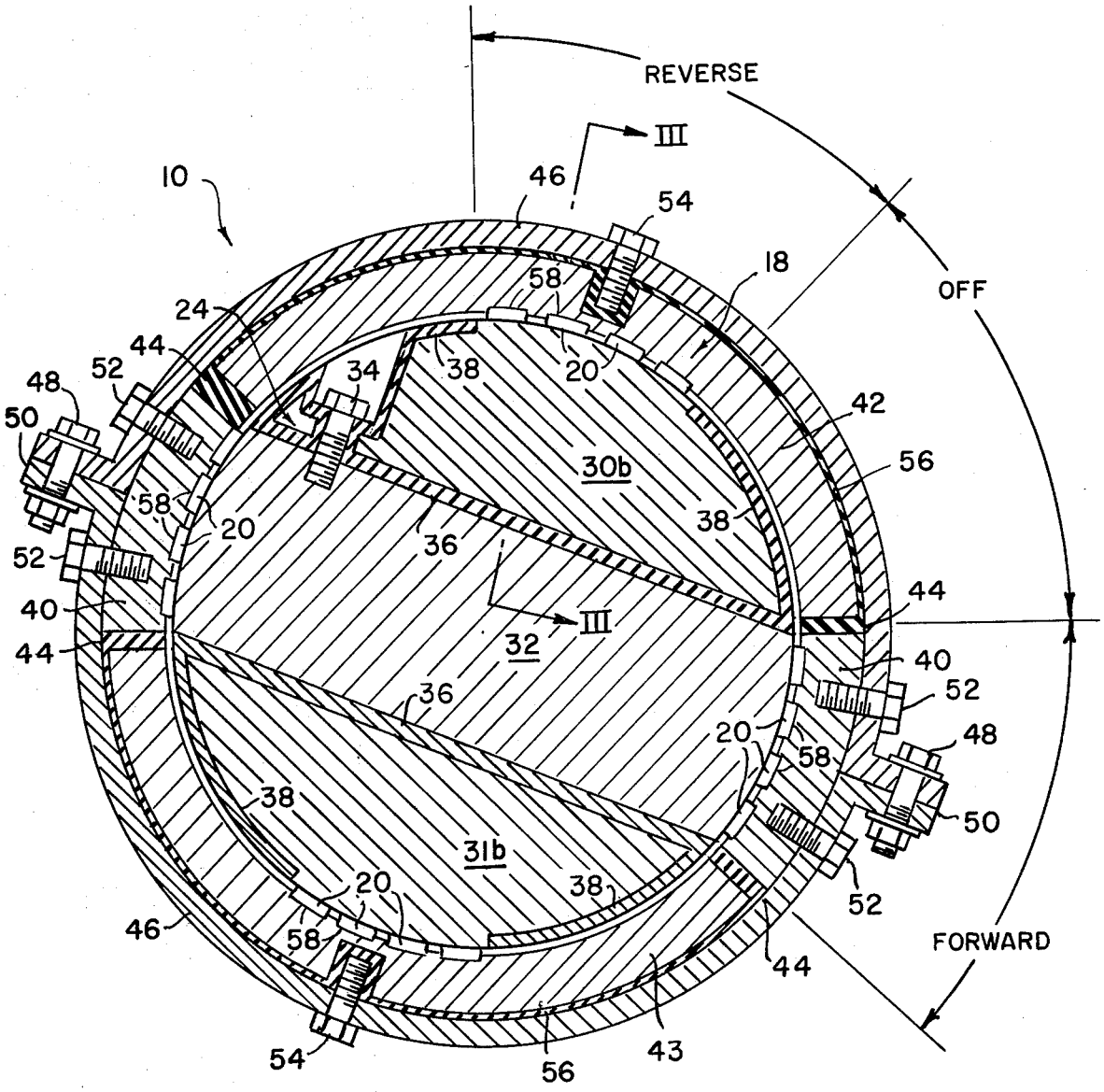
FIG. 1 is a cross-sectional, view of the coaxial switch.
Figure 3:
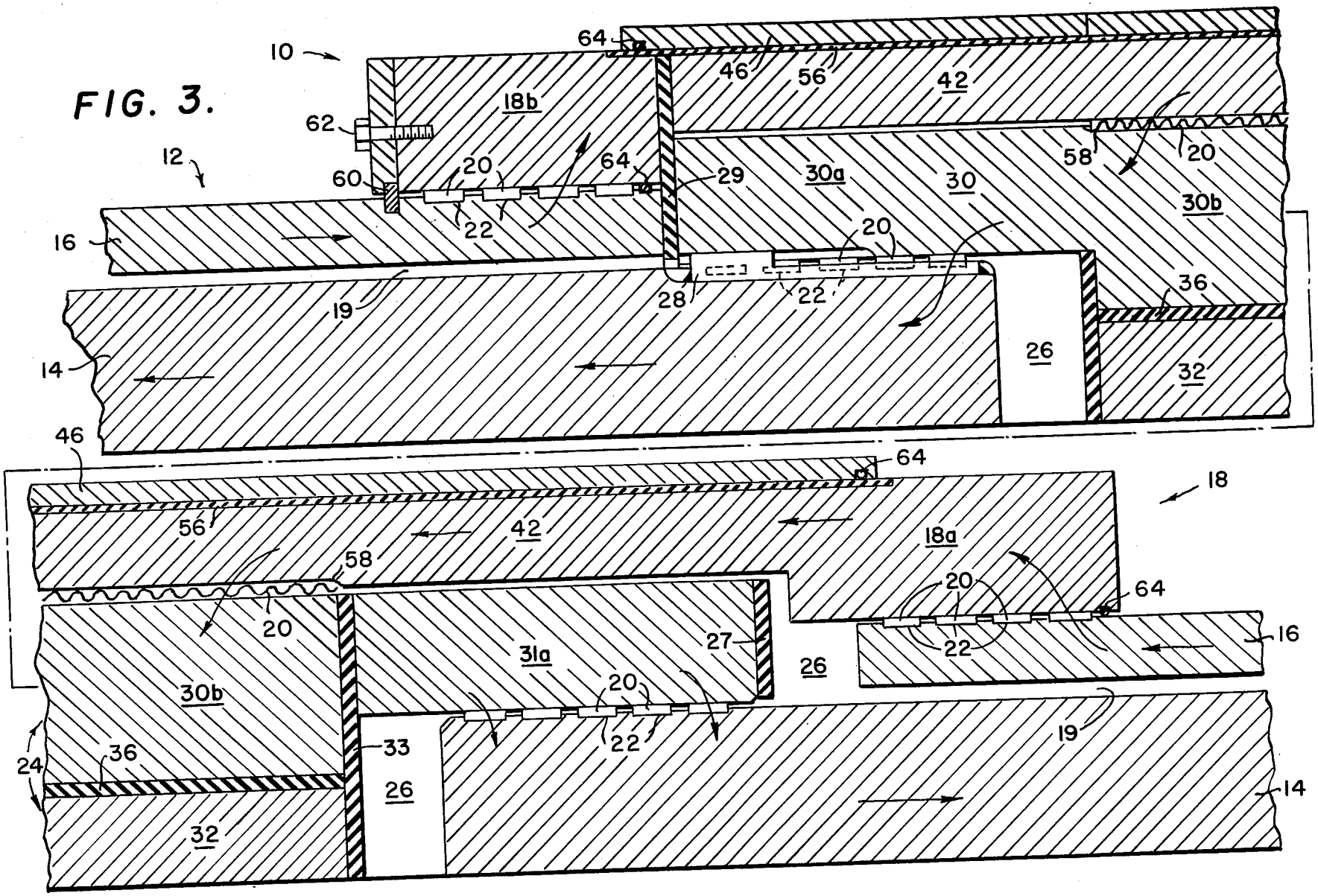
FIG. 3 is a longitudinal partially cut-away sectional view of the coaxial switch inserted into a coaxial transmission line. The cross sectional view of FIG. 3 is taken through the switch while it is in the reverse polarity position as shown in FIGS. 1 and 2.

Referring now to the drawings, wherein like reference numerals refer to the same part throughout the several views, there is shown generally in FIG. 1 and FIG. 3 a coaxial switch 10 electrically and mechanically inserted into a coaxial transmission line 12. As best seen in FIG. 3, to allow for the switch insertion, the coaxial line 12 has separated, opposing, and uniaxial ends. The transmission line or cable 12 is substantially rigid, and comprises an inner conductor 14 that may be a solid cylinder, and an outer conductor 16 that is coaxial with, spaced from and surrounds the inner conductor. Both conductors may be made of any suitable electrically conductive metal, such as aluminum, and as shown, they are separated by a space 19 through which non-conducting cooling fluid may be circulated.

Referring now particularly to the coaxial switch 10, there is included outer rotary switch member assembly 18 with a cylindrical portion **18*a* and a tongue segment 42 at one end of the switch and at the other end of the switch there is a cylindrical portion 18*b* and extending therefrom a tongue segment 43. The segment 42 is insulated from 18*b* by insulation 29 and segment 43 is similarly insulated from 18*a* (not shown). The portions 18*a* and 18*b* of 18 make contact with the outer coaxial conductors 16 at the ends of the transmission lines via a plurality of multi-louvered multi-contact strips 20, such as "multilam" manufactured by Multilam Corporation of California. These strips 20 are retained in annular grooves 22 which may be cut into the outer coaxial conductors 16 of the transmission line or in the outer switching member 18*a* and 18*b* as desired. This strip material has many spring contacts, and uses silver-plated, beryllium copper contacts to lessen contact resistance. Similarly the inner contact members 30 and 31 are composed of cylindrical portions 30*a* and 31*a* and having a tongue segment 30*b* and a similar tongue on 31 (not shown). The cylindrical segments 30*a* and 31*a* of a members 30 and 31 contact the inner coaxial conductors 14 at the ends of the transmission lines via multi-contact strips 20 retained in annular grooves 22. Both the outer switch member assembly 18 and the inner switch member assembly 24 composed of members 30, 31 and 32 may be made of aluminum, for example. Spaces 26 are provided, between the ends of the coaxial conductors 14 and 16** and the switch members, for longitudinal expansion thus allowing for thermal expansion and contraction of the conductors.

The inner coaxial conductor 14, has at the left end as shown, a keyway with a key 28 welded therein. A coacting slot in the inner switch member **30*a* is provided to prevent relative rotation of the inner switch member assembly 24 relative to the inner coaxial conductor 14. The inner switch member assembly 24 as stated above is made up of parts 30, 31 and 32. The inner switch conductors 30 and 31 each have cylindrical portions 30*a* and 31*a* and tongue portions 30*b* and 31*b* (FIG. 1) (not shown). In addition the central switch conductor 32 has a substantially rectangular shape but is arcuate on two of the opposite sides. Two of the inner switch conductors, members 30 and 31, are insulated from and sandwich over opposite sides of the third central switch conductor member 32. Thus together they form a composite cylinder. These members are all secured together by a plurality of insulated bolts 34 (one shown). These insulated bolts 34**, may be of an insulating material, or have insulating washers therearound, but in any event, they form no electrical connection between the member parts.

The inner switch conductor members 30 and 31 are separated from member 32 by insulating plates 36. Each of the members 30 and 31 has insulating sections 38 inlayed along a portion of its arcuate surface and which is joined to the insulating plates 36 along opposite edges. The inlayed insulation material, which may be an epoxy or other appropriate material prepared to obtain a flush surface, extends along the arcuate surfaces of 30 and 31 away from the central conductor 32 to cover approximately two thirds of the arcuate surface of each of the conductors 30 and 31, extending from each edge of the arcuate surface leaving one-third of each surface bare and capable of electrical contact.

Surrounding the inner switch member assembly 24, is the outer rotary switch member assembly 18 comprising short outer cylindrical contact segments **18*a* and 18*b* positioned at opposite ends of the switch and insulated from each other and, two outer contact tongue segments 42 and 43 also diametrically opposite each other. Completing the hollow cylinder are two contact sections 40, positioned between the edges of tongues 42 and 43 on opposite sides of the cylinder together forming the outer rotary switch member assembly 18. The segments 40, 42, and 43 are electrically insulated and separated from one another by insulation 44 and 56 which may be of epoxy material. Holding the outer contact sections 40 and the outer contact segments 42 and 43 together to form a hollow cylinder is an outer split shell 46 made of an electrical conductor surrounding the outer segments 42 and 43 but insulated from them. This outer split shell makes electrical contact with the sections 40. The split shell 46 is circumferentially tightened by two diametrically opposed clamp bolts 48, passing through two opposing lugs 50. The sections 40 are structurally and conductively secured for rotation with the shell 46 by metal bolts 52. The segments 42 and 43 are secured for rotation with the shell 46 by insulated bolts 54. These bolts are insulated because electrical connection is not desired between the shell and segments 42 and 43. Further, insulation 56 electrically separates the outer periphery of the segments 42 and 43 from the split shell 46**.

Grooves 58 are longitudinally formed in the inner diameter of each of the sections 40, and the tongue segments 42 and 43, for retaining some of the aforementioned multi-contact strips 20.

Referring now to FIG. 3, the outer switch member assembly 18 is restrained from relative axial movement but permitted rotary movement with the outer conductor 16 of the first end (left end as shown) of the coaxial transmission line 12, by a retaining and bearing ring 60 fastened to a part of the outer switch member assembly 18 by a plurality of bolts 62 (one shown). "O"-ring seals 64 are provided around and between the outer coaxial conductor 16 and each end of the outer rotary switch members. "O"-rings seal 64 are also provided around and between the split shell 46 and the hollow cylinder formed by the sections 40 and the segments 42 and 43.

Figure 2C:
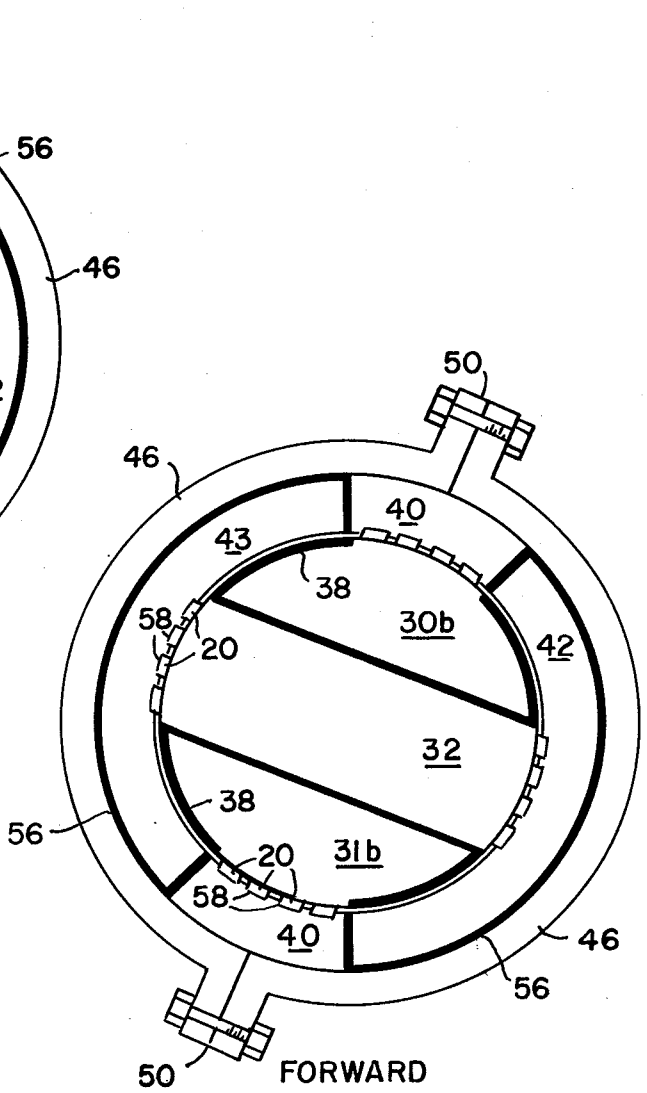
Figure 2B:
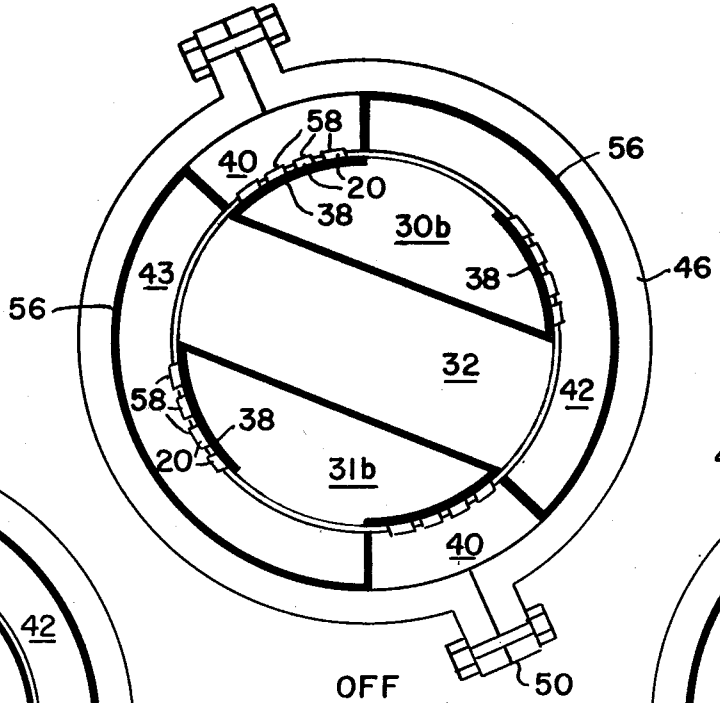
Figure 2A:
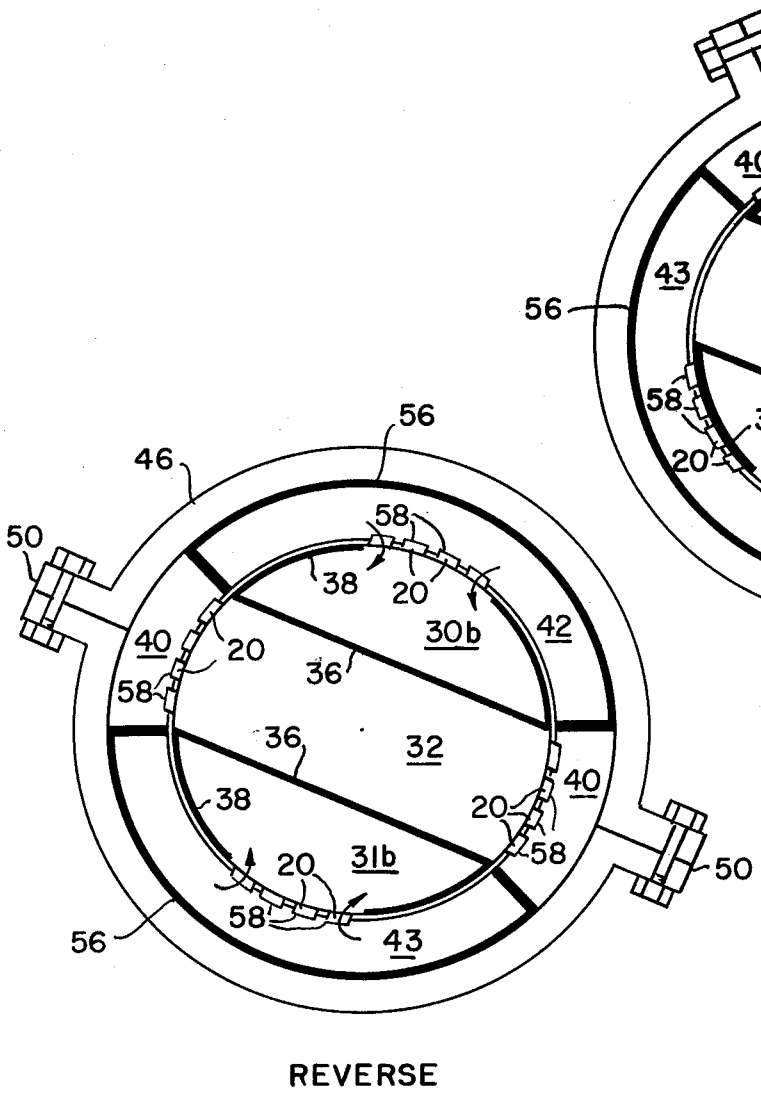

The operation of the coaxial, polarity-reversing switch with rotary actuation is best shown in various positions schematically in FIGS. 2*a*, 2*b*, and 2*c*. Reference to FIGS. 1 and 3 shows in detail how the current flows through various switch parts and into and out of the coaxial conductors. As can be seen, FIG. 1 depicts the outer rotary switch member assembly 18 rotated counter-clockwise from the "off" position to the reverse position for reverse polarity current transfer as shown in FIG. 2*a*.

Referring to FIGS. 1, 2*a*, and 3, the current flows, as shown by arrows in FIGS. 2*a* and 3 from a source (not shown) through the outer coaxial conductor 16 (on the right in FIG. 3) through contact strips 20, in grooves 22, into and through outer rotary switch member segment 18*a* then into segment 42. From segment 42, the current flows through other contact strips 20, in grooves 58, and into inner switch member 30*b*. Thence the current flows through still other contact strips 20, in grooves 22, in 30*a* into the inner coaxial conductor 14 (at the left in FIG. 3) connected to a load (not shown). The return current, shown by arrows in FIGS. 2*a* and 3 from the load (not shown), flows from the outer coaxial conductor 16 (on the left in FIG. 3) through contact strips 20 in grooves 22, into and through the other outer rotary switch member segment 18*b* into segment 43. Then from segment 43 the current flows through other contact strips 20, in grooves 58, and into the other inner switch member 31. Thence the return current flows through still other contact strips 20, in grooves 22 in segment 31*a* into the inner coaxial conductor 14 (at the right in FIG. 3) connected back to the generator (not shown).

Referring to FIG. 2*b*, where the switch is in the "off" position, the outer rotary switch member assembly 18 has been rotated 45° clockwise from the position shown in FIG. 2*a*. Here, one outer rotary switch segment 42, particularly its contact strips 20 in grooves 58, are positioned over one of the areas of insulation 38 inlayed in segment 30. This precludes electrical contact between 42 and 30 and thus the flow of current from the source (not shown) to the load (not shown). Also, the other outer rotary switch segment 43, particularly its contact strips 20 in grooves 58, are positioned over the inlayed insulation 38 in the other inner switch member 31 precluding electrical contact and therefore the flow of current from one end to the other of the switch.

Referring to FIG. 2*c*, where the switch is in the forward polarity position, the outer rotary switch member assembly 18 has been rotated 45° clockwise from the "off" position. Here, the current flows from the source (not shown) through the outer coaxial conductor 16 (on the right in FIG. 3), through contact strips 20, in grooves 22, in segment 18*a* into and through the outer rotary switch member segment 42. The current then flows through the central switch member 32 across the diameter to the other side and then through contact strips 20 in groove 58 to the other outer rotary switch member segment 43. Then the current flows through segment 43 and to contact strips 20 in grooves 22, in segment 18*b* of segment 43 and into the outer coaxial conductor 16 (on the left in FIG. 3). The current flow in the other circuit though the switch is through the inner coaxial conductor 14 (on the left in FIG. 3), through the contact strips 20, in grooves 22 in segment 30*a* (shown in phantom behind key 28 in FIG. 3), into and through inner switch member 30. Then current flows from member 30, through the contact strips 20 in grooves 58, through section 40 to shell 46, around to the other short outer section 40, through contact strips 20 in grooves 58 into the inner switch member 31. In this circuit the current then flows along inner switch member 31 through contact strips 20, in grooves 22 into segment 31*a* the inner coaxial conductor 14 (on the right in FIG. 3).

Thus, by rotation of the outer switch member through 90°, as discussed above, the coaxial switch according to this invention can achieve connection for reverse polarity, through an "off" position; to a forward polarity position. Any lever or gear-driven mechanisms can be used to rotate the outer switch member, and because no part of this invention resides in such a mechanism, no particular one is shown. The entire switch may be made of any good electrical conductor, such as copper or aluminum, even though the coaxial cable is made of aluminum. The entire switch 10 and coaxial transmission line 12 voids may be filled with a non-conductive coolant which is circulated, and is retained by seals 64 to maintain low temperatures by removing any heat generated by the $I^2R$ losses occuring in the switch.

Obviously, many modifications and variations of the present invention are possible in the light of the above teachings. It is therefore to be understood that within the scope of the appended claims the invention may be practiced otherwise than as specifically described.

What is claimed is:

1. A coaxial high current switch having rotatable cylindrical outer switching means, and an inner switching means mounted coaxially of said outer means and operating in conjunction therewith for controlling the flow of current in the conductors of a coaxial cable, with the outer switching means including means for connecting the switch to the outer conductors of the coaxial cable, and with said inner means including means for connecting said switch to the inner conductor of the coaxial cable.

2. A switch as claimed in claim 1 in which said outer switching means includes a plurality of means for selectively making electrical contact with said inner switching means.

3. A switch as claimed in claim 2 in which said inner switching means includes a plurality of elements constituting means for selectively connecting the outer conductor of one end of the cable to the either the inner or outer conductor of the other end of the cable.

4. A switch as claimed in claim 2 in which said outer means includes a pair of outer contact members each of said outer contact members having a cylindrical portion and a arcuate tongue portion;

said members being assembled with the cylindrical portions at opposite ends of said switch and with the tongue portions on opposite sides of said switch and being insulated from each other;

said outer means further includes an outer split cylindrical member, said outer split cylindrical member being insulated from said outer contact members and a pair of arcuate members mounted on opposite side of said switch between the sides of the tongue portions and insulated therefrom, in electrical contact with said outer split cylindrical member to thereby form a rotatable cylindrical shell about said inner switching means.

5. A switch as claimed in claim 2 in which said inner switching means includes;

a pair of inner conductive members each having a cylindrical portion and a tongue portion having an outer arcuate surface;

said conductive members being mounted with their cylindrical portions at opposite ends of said switch and with said arcuate tongue portions lying on opposite sides of the switch, a section of each tongue portion making contact with said outer switch member in at least one position of said outer switch member.

6. A switch as claimed in claim 5 in which said inner switch means further includes a conductive member having arcuate surface sections and being insulated from and positioned between the tongue portions of said inner switch conductive members, such that said inner conductive members form a cylindrical inner switch means about which said outer switch means may be rotatably positioned.

7. A switch as claimed in claim 6 in which each of the arcuate surfaces of said tongue of said inner conductive member has insulation extending from each edge to cover substantially two thirds of said arcuate surface.

8. A switch as claimed in claim 7 in which each of the tongue sections of the outer contact members has a group of contacts mounted in the inner face of said tongues for rotation therewith for selectively making electrical contact with said inner conductive members in at least one position of said outer switching means.

9. A switch as claimed in claim 8 in which contacts are mounted in said arcuate members for rotation therewith for making electrical contact with said conductive member mounted between the tongues portions of said inner switch conductive members in at least one position of said outer switch means.

10. A switch as claimed in claim 9 in which said contacts are spaced approximately ninety degrees apart around the inner periphery of said outer switch means.

11. A switch as claimed in claim 1 which includes means for securing said outer switch means against axial movement relative to at least one of said outer cable conductors.

* * * * *